US011498825B2

(12) United States Patent
Yamashita et al.

(10) Patent No.: US 11,498,825 B2
(45) Date of Patent: Nov. 15, 2022

(54) LIQUID QUALITY MANAGING DEVICE AND METHOD

(71) Applicants: Asahi Group Holdings, Ltd., Tokyo (JP); Asahi Breweries, Ltd., Tokyo (JP)

(72) Inventors: Naoyuki Yamashita, Kashiwa (JP); Junichi Kitano, Kawaguchi (JP); Yasuhiro Kurabe, Soka (JP); Shinsuke Mitsuhata, Moriya (JP); Takashi Wada, Kobe (JP); Kenji Kusunoki, Kobe (JP); Hidetoshi Fukunari, Kobe (JP); Takuya Komura, Kobe (JP)

(73) Assignees: ASAHI GROUP HOLDINGS, LTD., Tokyo (JP); ASAHI BREWERIES, LTD., Tokyo (JP)

( * ) Notice: Subject to any disclaimer, the term of this patent is extended or adjusted under 35 U.S.C. 154(b) by 225 days.

(21) Appl. No.: 17/040,197

(22) PCT Filed: Nov. 30, 2018

(86) PCT No.: PCT/JP2018/044276
§ 371 (c)(1),
(2) Date: Sep. 22, 2020

(87) PCT Pub. No.: WO2019/181079
PCT Pub. Date: Sep. 26, 2019

(65) Prior Publication Data

US 2021/0009401 A1 Jan. 14, 2021

(30) Foreign Application Priority Data

Mar. 23, 2018 (JP) ..... JP2018-056631

(51) Int. Cl.
*B67D 1/08* (2006.01)
*F25D 11/00* (2006.01)

(52) U.S. Cl.
CPC ..... *B67D 1/0867* (2013.01); *F25D 11/00* (2013.01); *B67D 2210/00104* (2013.01); *F25D 2331/802* (2013.01)

(58) Field of Classification Search
CPC ..... B67D 1/0867; B67D 2210/00104; F25D 11/00; F25D 2331/802
(Continued)

(56) References Cited

U.S. PATENT DOCUMENTS 8,387,826 B2 * 3/2013 Tsubouchi ..... B67D 1/1211 222/61
8,485,394 B2 * 7/2013 Tachibana ..... B67D 1/0884 222/129.1
2010/0276451 A1 * 11/2010 Tachibana ..... B67D 1/04 222/190

FOREIGN PATENT DOCUMENTS

GB 2 446 728 8/2008
JP 63-190880 12/1988
(Continued)

OTHER PUBLICATIONS

International Preliminary Report on Patentability dated Sep. 29, 2020 in International (PCT) Patent Application No. PCT/JP2018/044276, with English Translation.
(Continued)

*Primary Examiner* — Lien M Ngo
(74) *Attorney, Agent, or Firm* — Wenderoth, Lind & Ponack, L.L.P.

(57) ABSTRACT

A liquid quality management device capable of being added to a liquid supply system supplying a liquid in a storage container to a dispensing device in order to cool the liquid and dispensing the liquid into a drinking container includes: a dispensing sensor; and a control device electrically connected to the dispensing sensor and configured to perform control operation of at least one of a refrigeration machine
(Continued)

and a stirring device provided in the dispensing device at the same time when dispensing of the liquid is started.

6 Claims, 5 Drawing Sheets

(58) Field of Classification Search
USPC ..... 222/146.6, 23, 54, 61, 1
See application file for complete search history.

(56) References Cited

FOREIGN PATENT DOCUMENTS

| | | |
|---|---|---|
| JP | 6-227595 | 8/1994 |
| JP | 9-165098 | 6/1997 |
| JP | 2000-88425 | 3/2000 |
| JP | 2000-203694 | 7/2000 |
| JP | 2017-124849 | 7/2017 |

OTHER PUBLICATIONS

International SearchReport dated Mar. 5, 2019 in International (PCT) Application No. PCT/JP2018/044276.
Extended European Search Report dated Nov. 24, 2021 in corresponding European Patent Application No. 18910719.6.

* cited by examiner

LIQUID QUALITY MANAGING DEVICE AND METHOD

TECHNICAL FIELD

The present invention relates to a liquid quality management device which can be added to a liquid supply system and method, and more specifically, to a liquid quality management device and method which performs liquid quality management by focusing on control of a cooling device included in a liquid dispensing device provided in the liquid supply system.

BACKGROUND ART

In a restaurant, a liquid supply system is generally used as a device for providing liquid, for example, beer. When the beer is used as an example, the liquid supply system includes a carbon dioxide gas cylinder, a beer barrel filled with the beer, a supply pipe, and a beer dispenser. The liquid supply system pressurizes the beer within the beer barrel with carbon dioxide gas of the carbon dioxide gas cylinder, and transfers the liquid with pressurization from the supply pipe to the beer dispenser. The beer dispenser has a beer cooling pipe provided within a cooling tank, a refrigeration machine, and a dispensing outlet. The beer dispenser freezes a part of a cooling water within the cooling tank by using the refrigeration machine, cools the beer while causing the beer to flow within the beer cooling pipe due to a lever operation at the dispensing outlet, and dispenses the beer to a drinking container such as a beer mug.

In this way, the beer in the beer barrel is provided for a customer.

As described above, in the beer dispenser of a type generally called an instant cooling type, the beer is dispensed while being cooled with heat exchange between the beer passing through the inside of the beer cooling pipe immersed in the partially frozen cooling water and the cooling water. In addition, in order to perform efficient heat exchange, the beer dispenser further includes a stirring device for stirring the cooling water in the cooling tank. The stirring device has a stirring blade and a stirring motor for rotationally driving the stirring blade.

On the other hand, the beer barrel filled with the beer is often placed in a room temperature environment. Therefore, in summer, etc., since the heat exchange with the beer having almost room temperature is performed at especially near an inlet side of the beer cooling pipe in the cooling water within the cooling tank, temperature of the cooling water rises and ice in the cooling water melts. Therefore, for example, by detecting an amount of ice in the cooling water, operating the refrigeration machine based on a change in the amount of ice to lower the temperature of the cooling water, and stirring the cooling water by using the stirring device, the temperature of the cooling water is maintained within a set range, and temperature of the dispensed beer is maintained within a predetermined range.

PRIOR ART DOCUMENTS

Patent Documents

Patent Document 1: JP 2017-124849 A

SUMMARY OF THE INVENTION

Problems to be Solved by the Invention

As disclosed in the above Parent Document 1, conventionally, in the instant cooling type beer dispenser, a conductivity sensor (IBC sensor) is used to detect a frozen state, for example, an amount of ice or a position of ice. As described above, in general, when the beer is dispensed from the beer dispenser into the drinking container, the temperature of the cooling water rises and the frozen state changes. Therefore, the conventional instant cooling type beer dispenser adopts control in which a change in the frozen state is detected through the conductivity sensor and the refrigeration machine in the beer dispenser is operated or rotation speed of the stirring device is changed through the detection.

On the other hand, there is a time lag between a start of the operation of the refrigeration machine or the change in the rotation speed of the stirring device and a decrease in temperature of the beer passing through the inside of the beer cooling pipe, due to a heat transfer characteristic, a neat exchange characteristic, etc. between the cooling water and the beer cooling pipe. Therefore, the temperature of the beer does not immediately drop even when the refrigeration machine or the like is started, and the temperature of the beer dispensed during the time lag may be higher than a target dispensing temperature, for example, about 5° C., for quality management of beer to be provided. Such a situation is highly likely to occur in summer when temperature of an environment where the beer barrel is placed is relatively high, and during busy times.

The present invention has been made to solve such a problem, and an object of the present invention is to provide a liquid quality management device and management method capable of providing liquid with more stable quality than a conventional case, specifically, capable of increasing an amount of dispensed liquid maintained in a predetermined dispensing temperature range as compared with the conventional case.

Means for Solving the Problems

To achieve the above object, the present invention is configured as follows.

In other words, a liquid quality management device according to an aspect of the present invention is a liquid quality management, device capable of being added to a liquid supply system, the liquid supply system supplying a liquid within a storage container to a dispensing device through a supply pipe with the liquid pressurized in order to cool the liquid with a cooling device in the dispensing device, and dispensing the cooled liquid to a drinking container from the dispensing device, the cooling device including a cooling tank containing cooling water, a liquid cooling pipe immersed in the cooling water and through which the liquid flows inside, a refrigerant pipe immersed in the cooling water and through which a refrigerant flows inside, a refrigeration machine circulating the refrigerant and freezing a part of the cooling water, and a stirring device stirring the cooling water, the liquid quality management device comprising:

a dispensing sensor configured to detect dispensing of the liquid into the drinking container; and a control device electrically connected to the dispensing sensor and configured to control operation of at least one of the refrigeration machine and the stirring device from a starting time of dispensing of the liquid.

Effects of the Invention

The liquid quality management device according to the aspect of the present invention includes the dispensing sensor and the control device, thereby controlling the operation of at least one of the refrigeration machine and the stirring device from the dispensing operation start time of the liquid. As a result, it is possible to provide the liquid with more stable quality than a conventional case. Specifically, it is possible to increase an amount of dispensed liquid within a predetermined dispensing temperature range as compared with the conventional case.

EMBODIMENTS OF THE INVENTION

Figure 1:
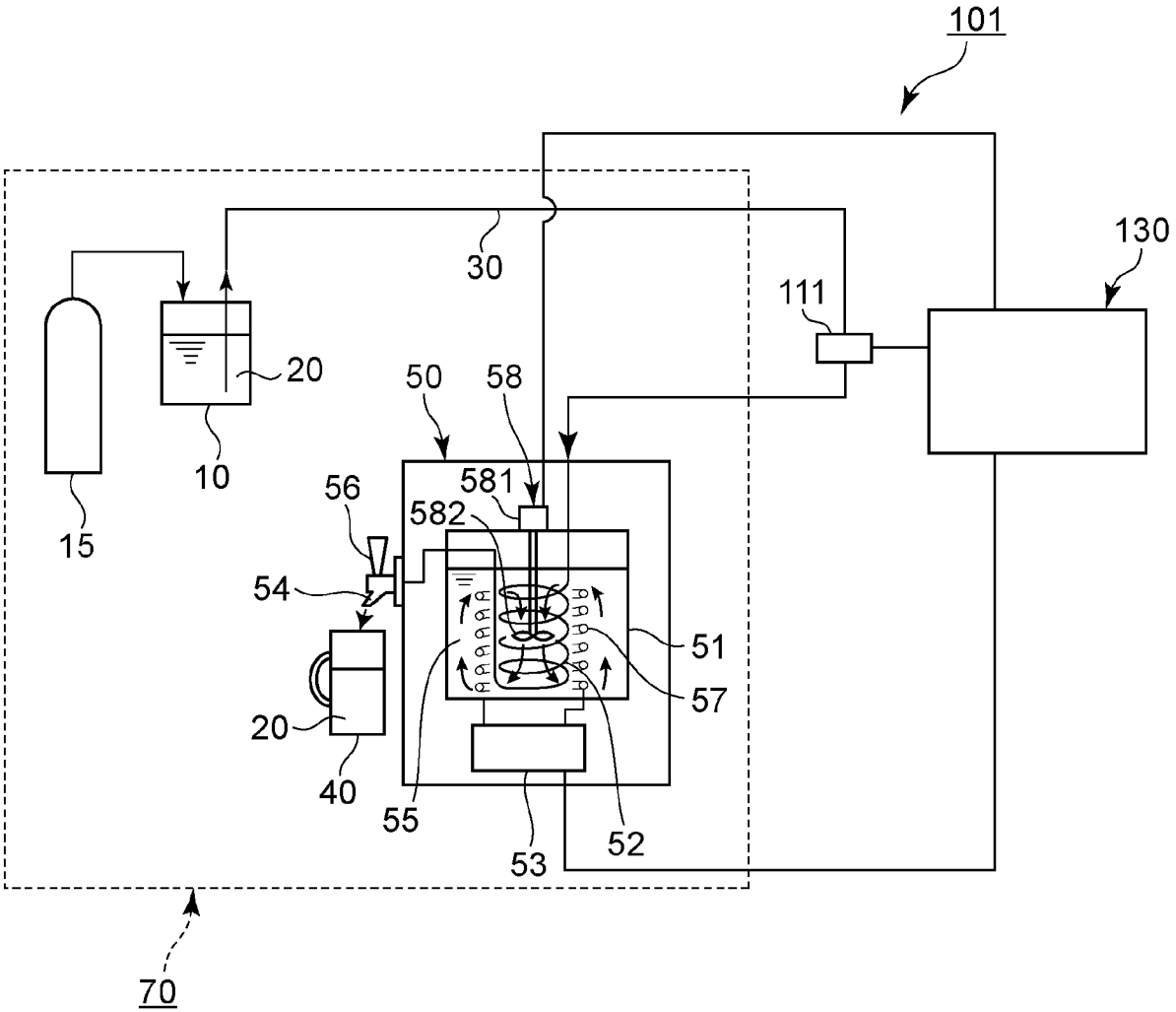
FIG. 1 is a block diagram showing a basic configuration of a liquid quality management device common to each embodiment of the present invention.

A liquid quality management device and a liquid quality management method according to embodiments of the present invention will be described below with reference to the drawings. Note that, in the drawings, the same or similar components are denoted with the same reference symbols. In addition, in order to avoid the following description from being unnecessarily redundant and to facilitate the understanding of those skilled in the art, detailed description of well-known matters and redundant description of substantially the same configuration may be omitted. Furthermore, the following description and the contents of the accompanying drawings are not intended to limit the subject matter described in the claims.

As shown in FIG. 1, the liquid quality management device according to embodiments described below is a liquid quality management device 101 which can be added, that is, which can be electrically and mechanically connected, to an existing liquid supply system 70. In the present embodiment, one liquid quality management device 101 is attached to one set of the liquid supply system 70.

As described above, conventionally, the sensor for detecting the frozen state is used to control the refrigeration machine and the stirring device after the frozen state changes.

On the other hand, the liquid quality management device and method according to the embodiments largely differ from the conventional technique in that at least one of the refrigeration machine and the stirring device is controlled before the frozen state changes. It should be noted that the control relating to the refrigeration machine will be described in a first embodiment and the control relating to the stirring device will be described in a second embodiment.

Further, in the embodiments, beer is used as an example of a liquid to be handled, but the liquid is not limited to beer. The liquid may be an alcoholic beverage such as low-malt beer (Happoshu), liqueur, white liquor highball (Chuhai), whiskey, and wine, drinking water, soft drinks, and carbonated drinks, and the like.

First Embodiment

First, the liquid supply system 70 will be described. Note that the description of the liquid supply system 70 is common to the second embodiment.

The liquid supply system 70 has a storage container 10, a pressurizing source 15, a supply pipe 30, and a dispensing device 50. The liquid supply system 70 is a system in which liquid (beer in the embodiment, as described above) 20 in the storage container 10 is supplied or transferred to the dispensing device 50 through the supply pipe 30 with pressure applied by using the pressurizing source 15 and is dispensed from the dispensing device 50 to a drinking container (for example, a mug) 40. Here, in the embodiment, the storage container 10 is a stainless steel container called a beer barrel filled with beer in a beer manufacturer, and has a capacity of, for example, 5 liters, 10 liters, 19 liters, or the like. The pressurizing source 15 is a carbon dioxide gas cylinder. The supply pipe 30 is a flexible resin tube made of, for example, polyamide, polyurethane, polyester, or the like, which allows beer to How between the storage container 10 and the dispensing device 50. As described later, devices included in the liquid quality management device 101 are attached to the supply pipe 30. Also, from the supply pipe 30 to a liquid dispensing outlet 54 in the dispensing device 50, it is preferable that an inner diameter of a fluid flow passage is designed to have the same dimension such that a cleaning with a sponge becomes easy.

In the present embodiment, a description will be given of a beer dispenser (sometimes referred to as a "beer server") as an example of the above-described dispensing device 50 (therefore, in some cases, it will be described below as the beer dispenser 50). As described above, the beer dispenser 50 includes a liquid cooling pipe (beer cooling pipe in the embodiment) 52 and a refrigerant pipe 57 disposed in a cooling tank 51, a refrigeration machine 53, the liquid dispensing outlet 54, and a stirring device 58. Here, a cooling device includes the cooling tank 51, the liquid cooling pipe 52, the refrigeration machine 53, the refrigerant pipe 57, and the stirring device 58.

Figure 2:
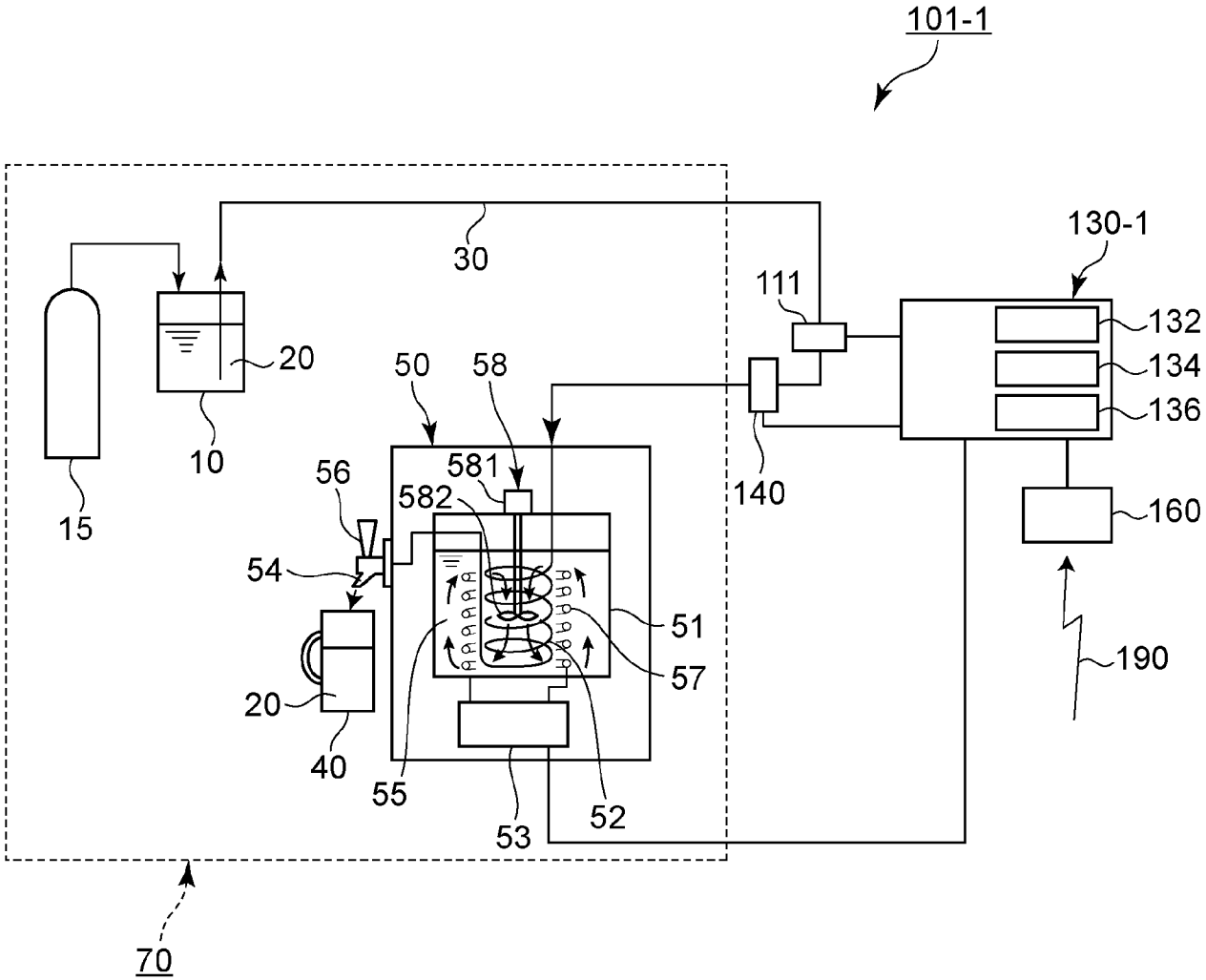
FIG. 2 is a block diagram showing a configuration of a liquid quality management device according to a first embodiment of the present invention.
Figure 3:
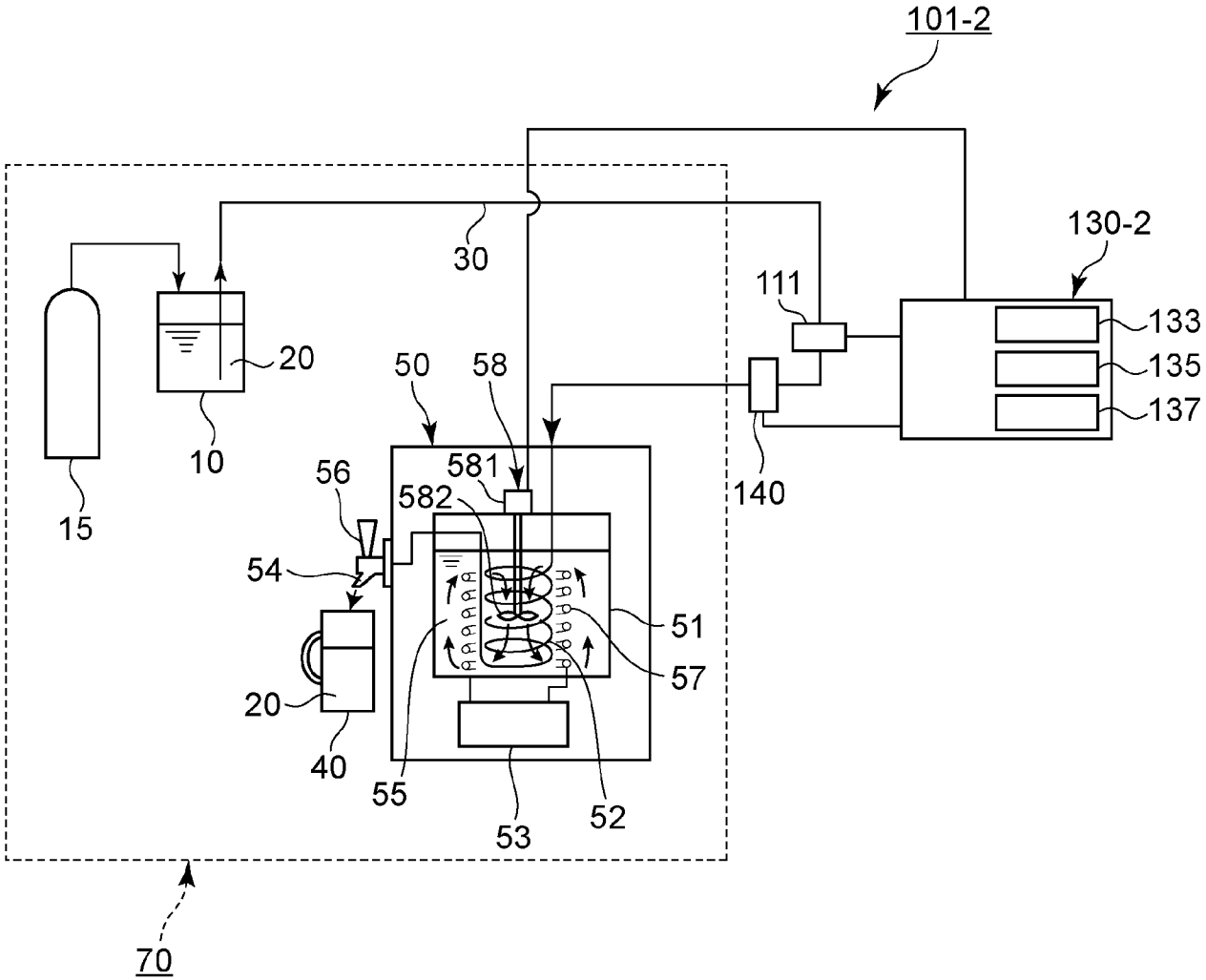
FIG. 3 is a block diagram showing a configuration of a liquid quality management device according to a second embodiment of the present invention.

The liquid cooling pipe 52 is a pipe formed in a spiral shape through which the beer (liquid) 20 having be transferred with pressurization within the supply pipe 30 passes inside. In the present embodiment, the liquid cooling pipe 52 is disposed at a center side of the cooling tank 51, and most of it is immersed in cooling water 55 (FIGS. 1 to 3). Further, the liquid cooling pipe 52 is made of stainless steel, for example.

The refrigeration machine 53 is composed of a compressor and a condenser for a refrigerant, a cooling fan for cooling the condenser, and the like, and the refrigeration machine evaporates the compressed and condensed refrigerant in the refrigerant pipe 57 and circulates it.

The refrigerant pipe 57 is also formed in a spiral shape. In the present embodiment, in the cooling tank 51, the refrigerant pipe 57 is disposed outside the liquid cooling pipe 52, that is, at a side wall side of the cooling tank 51, and most of it is immersed in the cooling water 55 (FIGS. 1 to 3). Therefore, the cooling water 55 around the outside of the refrigerant pipe 57 is cooled through evaporation of the refrigerant when passing through the inside of the refrigerant pipe 57, and further, a part of the cooling water 55 is frozen. Further, the refrigerant pipe 57 is made of metal, for example, copper or the like, having high thermal conductivity.

Note that regarding a positional relationship between the liquid cooling pipe 52 and the refrigerant pipe 57 in the cooling tank 51, contrary to the configuration of the present embodiment, the refrigerant pipe 57 may be located at the center side, and the liquid cooling pipe 52 may be located outside the refrigerant pipe 57 and at the side wall side.

The stirring device 58 is a device which stirs the cooling water 55 stored in the cooling tank 51, is disposed at the center of the cooling tank 51, and has a stirring blade 582 and a stirring motor 583 that rotationally drives the stirring blade 582. The rotation of the stirring blade 582 causes convection of the cooling water 55 from a lower part to an upper part of the cooling tank 51. This facilitates heat exchange between the beer passing through the inside of the liquid cooling pipe 52 and the cooling water 55.

In addition, the stirring motor 581 basically rotates the stirring blade 582 continuously without stopping, if there is no malfunction.

According to the above configuration, the beer (liquid) 20 transferred with pressurization into the liquid cooling pipe 52 passes through the inside of the beer (liquid) cooling pipe 52 due to operation of a lever 56 disposed at the liquid dispensing outlet 54, is cooled with the heat exchange described above, is dispensed into the drinking container 40 such as a mug, and is provided for a customer. Note that in a case of the beer, for example, 5° C. is set as a target value as an appropriate liquid temperature provided for the customers.

Note that the beer dispenser 50 is generally used in an environment where outside air temperature is 5° C. or more and 40° C. or less. Also, the liquid 20 handled by using the dispensing device 50 is not limited to the beer, and may be the above-mentioned drinking water or the like. Further, in the embodiment, the beer dispenser 50 also cools beer that is target liquid, and the dispensing device 50 included in the embodiment may heat or keep warming the target liquid.

Next, a configuration of the liquid quality management device 101 that can be added to the liquid supply system 70 having the above described configuration and is common to the embodiments will be described.

The liquid quality management device 101 is a device which makes it possible to increase an amount of dispensed liquid kept in a predetermined dispensing temperature range, as compared with the conventional one.

Such a liquid quality management device 101, as shown in FIG. 1, has a basic configuration including a flow rate sensor 111 corresponding to an example of a dispensing sensor and a control device 130. By controlling operation of at least one of the refrigeration machine 53 and the stirring device 58 from a starting time of dispensing the liquid 20 from the dispensing device 50, it is possible to increase the amount of dispensed liquid within the predetermined dispensing temperature range, as compared with the conventional one.

The above dispensing sensor is a sensor for detecting a dispensing start of the liquid 20 from the dispensing device 50, and the flow rate sensor 111 is used as described above in the present embodiment. In addition, a liquid temperature sensor 140 to be described below, for example, means for detecting operation of the lever 56 of the dispensing device 50, or the like can be used as the dispensing sensor.

In addition to these basic configurations of the liquid quality management device 101, a liquid quality management device 1011 of the first embodiment shown in FIG. 2 further includes the liquid temperature sensor 140 and a receiving unit 160. Note that the control device 130 is referred to as a control device 130-1 in the first embodiment. With such a configuration, the control device 130-1 can include a consumed coolability acquisition unit 132, an operation time acquisition unit 334, and a time management unit 136.

In the liquid quality management device 101-1 of the first embodiment, the receiving unit 160 and the time management unit 136 in the control device 130-1 are not essential elements but optional components.

These components will be sequentially described below.

The flow rate sensor 111 is a sensor for detecting an amount of liquid dispensed into the drinking container 40, and in the embodiment, is installed so as to sandwich the supply pipe 30 within which beer passes through at a suitable position between an outlet of the storage container 10 and the beer dispenser 50. Note that the installation position is not limited to this, and the flow rate sensor 111 may be attached to, for example, the supply pipe 30 in the dispensing device 50. As the flow rate sensor 111, an ultrasonic sensor is used in the present embodiment. In addition, an electromagnetic flow meter, a flow detection device according to the applicant's previous application (Japanese Patent Application No. 2017-079702), or the like can be used.

In the embodiment, by using the How rate sensor 111 as the dispensing sensor, the dispensing start and a dispensing stop of the liquid 20 from the dispensing device 50 can be detected through fluid amount detection, and the amount of liquid and dispensing time can be detected. In the embodiment, it suffices if the dispensing start and the dispensing stop of the liquid 20 can be detected. So, as described above, instead of the flow rate sensor 111, means that can detect the dispensing start and the dispensing stop of the liquid 20 such as a sensor for detecting operation of the lever 56 at the liquid dispensing outlet 54 can be used as the dispensing sensor.

Further, based on a detection signal of the flow rate sensor 111, the liquid quality management device 101-1 may further seek an actually measured flow rate of the liquid 20, which is beer in the present embodiment, dispensed into the drinking container 40 from the dispensing device 50.

The liquid temperature sensor 140 is a sensor for measuring a liquid temperature inside the storage container, which is a temperature of the liquid 20 inside the storage container 10. As shown in Pig. 2, for convenience, the liquid temperature sensor 140 is installed at a proper position of the supply pipe 30 between the outlet of the storage container 10 and an inlet of the liquid cooling pipe 52 in the dispensing device 50. As described above, in the present embodiment, the temperature of the liquid 20 flowing out from the storage container 10 and flowing through the supply pipe 30 is regarded as the liquid temperature inside the storage container. As the liquid temperature sensor 140, for example, a thermistor, a resistance temperature detector, a semiconductor temperature sensor, a thermocouple, or the like can be used.

Note that the installation position of the sensor is not limited to the above-mentioned position, and may be attached to the supply pipe 30 in the dispensing device 50, for example. Further, when the liquid 20 is drinkable like beer, the liquid temperature sensor 140 is naturally installed in a structure that complies with predetermined regulations. Further, since the liquid temperature sensor 140 can detect a temperature change caused by dispensing the liquid (the liquid dispensing) as described below, as an example of the dispensing sensor, it can also be used as a sensor for detecting the dispensing start and the dispensing stop of the liquid 20 from the dispensing device 50.

The above liquid temperature sensor 140 is electrically connected to the control device 130-1.

Further, the liquid temperature sensor 140 can immediately detect the temperature change caused by dispensing the liquid, however due to a physical structure or the like for attaching the liquid temperature sensor 140 to the supply pipe 30, there is a slight, time delay when detecting steady-state liquid temperature, i.e., true liquid temperature. Due to such a detection characteristic of the liquid temperature sensor 140, in a state where the dispensing stop of the liquid 20 is continued, the liquid temperature sensor 140 sends a temperature substantially the same as ambient temperature of an environment in which the liquid supply system 70 is located. On the other hand, when the liquid dispensing is started from this state, the liquid temperature sensor 140 sends a temperature change that falls or rises with respect to the ambient temperature according to the liquid temperature of the storage container 10. Then, when the liquid dispensing is stopped, the liquid temperature sensor 140 again sends a temperature change that rises or fails to the ambient temperature.

Therefore, in each embodiment, the "liquid temperature" detected and sent through the liquid temperature sensor 140 means a temperature of the liquid 20 at time immediately before time ("immediately preceding time") when the temperature of the liquid 20 changes to the ambient temperature again immediately after the liquid dispensing is stopped.

The receiving unit 160 is electrically connected to the control device 130-1 and receives information via a communication line 190. The information to be received corresponds to, for example, date and time information, meteorological information such as weather and temperature, business information such as past sales on the same day, and the like.

The control device 130-1 provided in the first embodiment is electrically connected to the flow rate sensor 111, and controls operation of the refrigeration machine 53 from the starting time of dispensing of the liquid 20. In the configuration shown in FIG. 2, the control device 130-1 can include the consumed coolability acquisition unit 132, the operation time acquisition unit 134, and the time management unit 136, as described above.

Here, based on the temperature of the liquid 20 obtained from the liquid temperature sensor 140 and the amount of dispensed liquid obtained from the flow rate sensor 111, the consumed coolability acquisition unit 132 seeks or obtains a coolability consumed by the cooling water 55 in the dispensing device 50 (also referred to as "consumed coolability") due to the dispensing of the liquid 20. A case where an arithmetic expression is used as an example for obtaining the coolability is shown below, but method of obtaining is not limited to this. It is possible to apply a method derivable to those skilled in the art based on known technique.

As preconditions for the above arithmetic expression, a heat quantity required to lower a temperature of the liquid 20 (beer) of 1 cc by 1° C. is set to 1 cal, it is assumed that 80 cal of heat is absorbed per 1 cc when ice melts, and an appropriate temperature of the liquid 20 dispensed to the drinking container 40 is set to 5° C. as described above. The arithmetic expression is shown below.

> "Consumed coolability" accompanying liquid dispensing="amount of dispensed liquid"×"liquid temperature−dispensing temperature (5° C.)".

Next, the operation time acquisition unit 134 seeks or obtains an operation time of the refrigeration machine 53 according to the "consumed coolability" obtained through the consumed coolability acquisition unit 132 and a known (predetermined) coolability of the refrigeration machine 53. Here, the "coolability" of the refrigeration machine 53 is represented by "operation time of the refrigeration machine (that is, compressor) 53"×"ice storage capacity (amount of ice/min)". Here, the "ice storage capacity" is a known value for each dispensing device (beer dispenser) 50.

Therefore, the operation time of the refrigeration machine 53 can be calculated by using the following expression. Namely, "operation time"="amount of dispensed liquid"×"liquid temperature−dispensing temperature (5° C.)"/"ice storage capacity". Note that "amount of dispensed liquid"×"liquid temperature−dispensing temperature (5° C.)" is the above-mentioned "consumed coolability" accompanying the liquid dispensing.

As can be seen from this expression, if the liquid temperature obtained from the liquid temperature sensor 140 is 5° C. or lower (for example, this situation is caused when the storage container 10 is stored in a refrigerator), the operation time to be calculated is zero or a negative value. In such a case, the refrigeration machine 53 does not need to work.

Therefore, the control device 130-1 including the consumed coolability acquisition unit 132 and the operation time acquisition unit 134 can obtain the operation time of the refrigeration machine 53 based on each information obtained from the How rate sensor 111 and the liquid temperature sensor 140. Detailed description of this operation will be given later.

Next, the time management unit 136 will be described. The time management unit 136 has a clock function and can generate current time information and, date and time information of year-month-day. Further, the time management unit 136 has an input unit and a storage unit, and can store business hours information of a store through input with a staff of the store or input via the receiving unit 160.

Therefore, the control device 130-1 having the time management unit 136 can control the operation of the refrigeration machine 53 such that an ice storage amount in the cooling water 55 is optimized, in other words, the cooling water 55 has the maximum coolability at a set time such as business start time, busy time, etc. of the store. As a result, similarly to the above explanation, it is possible to provide the liquid (beer) 20 with more stable quality than the conventional case.

The above-described control device 130-1 is actually realized by using a computer system, and is composed of software corresponding to each function including the above-described operations of the consumed coolability acquisition unit 132, the operation time acquisition unit 134, and the time management unit 136, and hardware such as a CPU (central processing unit) for executing these and a memory. Note that it is preferable that the computer system corresponds to a microcomputer actually incorporated in the liquid quality management device 101, but a stand-alone personal computer can also be used.

Operation of the liquid quality management device 101-1 according to the first embodiment having the above-described configuration will be described below, particularly focusing on operation of the control device 130-1.

Note that in the liquid supply system 70, as described above, the liquid (beer) 20 is dispensed into the drinking container 40 by operating the lever 56 of the dispensing device (beer dispenser) 50 with a store staff. At this time, the liquid 20 is dispensed while being cooled with the heat exchange with the cooling water 55 when it is passing through the liquid cooling pipe 52. The cooling water 55 is maintained at approximately 0° C. with the operation of the refrigeration machine 53 and the stirring device 58 in the dispensing device 50.

Figure 4:
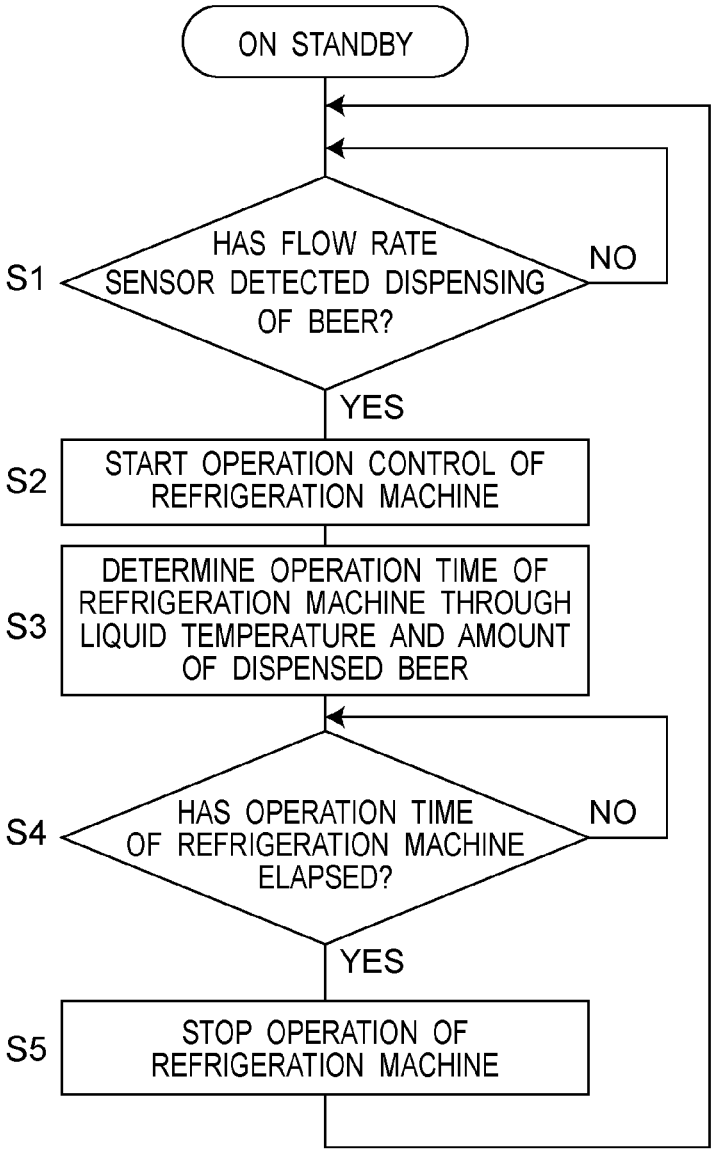
FIG. 4 is a flowchart showing operation of a liquid quality management method executed by using the liquid quality management device shown in FIG. 2.

The operation of the control device 130-1 will be described with reference to FIG. 4.

First, a basic control operation concept of the control device 130-1 is a technical idea that the refrigeration machine 53 is operated from the starting time of dispensing the liquid 20 from the dispensing device 50 on a basis of a coolability consumed through the cooling water 55 in the dispensing device 50 ("consumed coolability") due to the dispensing of the liquid 20.

In step S1, the flow rate sensor 111 which is an example of the dispensing sensor detects whether or not the liquid (beer) 20 is dispensed. Due to the dispensing of the liquid, the control device 130-1 starts operation control of the refrigeration machine 53 from the starting time of dispensing of the liquid 20 (step S2).

In the next step S3, the control device 130-1 seeks or obtains the "consumed coolability" based on each information obtained from the flow rate sensor 111 and the liquid temperature sensor 140, as described above, to obtain the operation time of the refrigeration machine 53.

In the next step S4, the control device 330-1 operates the refrigeration machine 53 for the obtained operation time, and stops the operation of the refrigeration machine 53 due to the operation time elapses (step S5).

In this way, the control device 130-1 starts the operation control of the refrigeration machine 53 from the starting time of dispensing the liquid 20. Therefore, operation control start time of the refrigeration machine 53 is earlier compared to the control that starts operation of the refrigeration machine from the time when the frozen state in the cooling water 55 changes as in the conventional case, and temperature rise start time of the cooling water 55 can be delayed compared to the conventional case. As a result, it is possible to increase an amount of beer dispensed at a target dispensing temperature, for example, about 5° C., for quality management of the beer (liquid 20) to be provided. In other words, it is possible to provide the liquid (beer) 20 with more stable quality than the conventional case.

Note that as shown in the above expression, in order to calculate the operation time of the refrigeration machine 53, it is necessary to fix the amount of dispensed liquid 20, that is, dispensing the liquid must be completed. On the other hand, in general, the operation time of the refrigeration machine 53 is much longer than the dispensing time of the liquid 20, and it is unlikely that the operation time has already passed when the liquid dispensing is completed. In other words, the storage container 10 is almost always placed at an ambient temperature of about 25° C., and therefore, the liquid temperature is almost the same as it. Under such an environment, the operation time of the refrigeration machine 53 under the condition of cooling the liquid 20 to the target dispensing temperature, for example, about 5° C., is about a few minutes according to the above expression, depending on the above-mentioned "ice storage capacity" of each dispensing device 50. On the other hand, dispensing time of the liquid 20 into the drinking container 40 of one cup, for example, about 380 cc is about ten and several seconds.

On the other hand, when the storage container 10 is placed in a refrigerator, the operation time of the refrigeration machine 53 may be zero as described above. In such a case, the operation of the refrigeration machine 53 will be immediately stopped according to a calculation result or detected liquid temperature.

Regarding a method of obtaining the operation time of the refrigeration machine, the arithmetic expression is used as described above in the present embodiment. On the other hand, in a case that the dispensing device 50 has, for example, a conductivity sensor (IBC sensor) for detecting a frozen state, the dispensing device 50 can have a configuration that the operation of the refrigeration machine 53 is stopped when the conductivity sensor detects that the predetermined frozen state has returned after the operation control of the refrigeration machine 53 is started.

Second Embodiment

Figure 5:
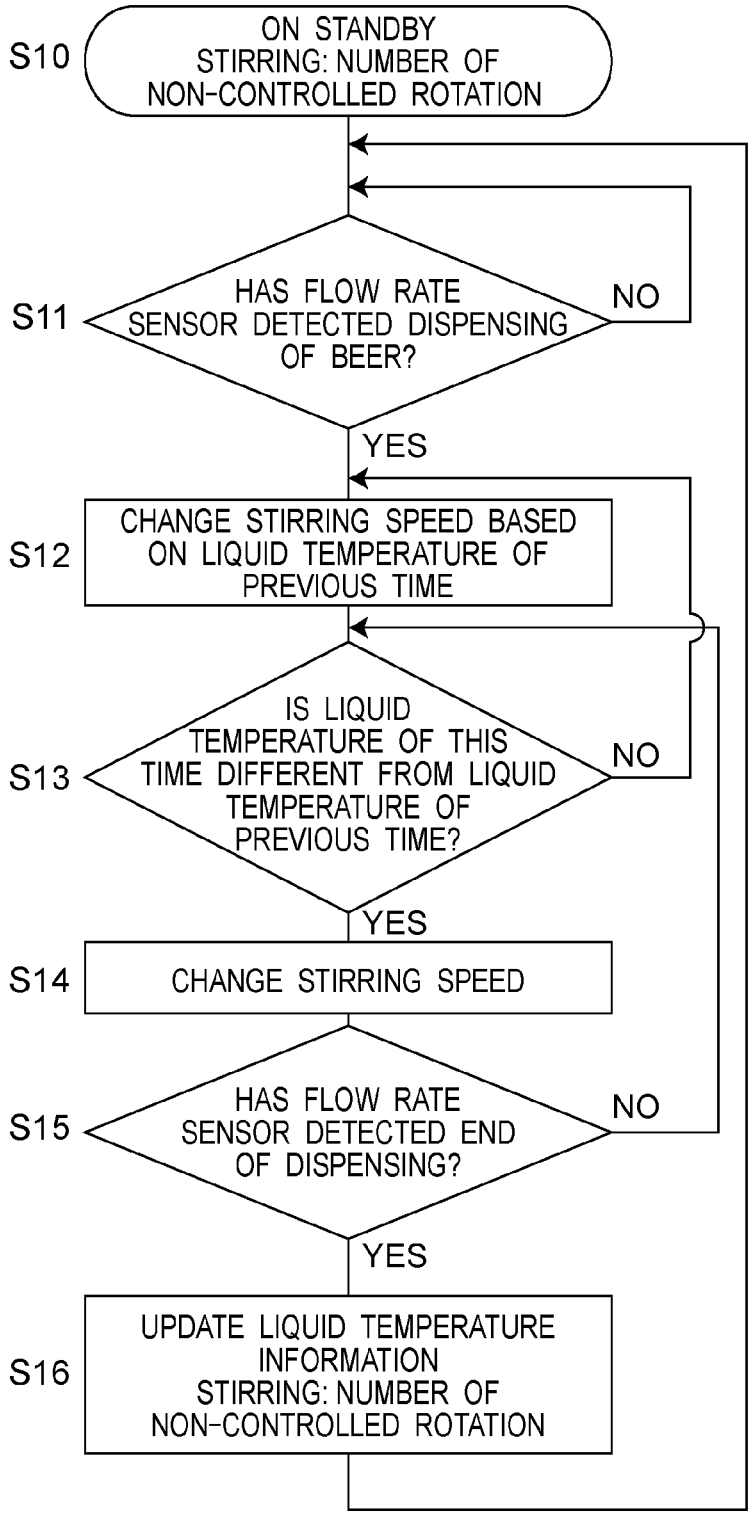
FIG. 5 is a flowchart showing operation of a liquid quality management method executed by using the liquid quality management device shown in FIG. 3.

Next, a liquid quality management device 101-2 according to a second embodiment which can be added to the above described liquid supply system 70 will be described with reference to FIGS. 3 and 5. As described above, the liquid quality management device 101-2 according to the second embodiment performs control regarding the stirring device before the frozen state changes. Specifically, the liquid quality management device 101-2 controls rotation speed of the stirring blade 582 of the stirring device 58.

As explained in the description of the stirring device 58, the stirring device 58 is a device for stirring the cooling water 55 in the cooling tank 51 by rotating the stirring blade 582 through the stirring motor 581, and for always bringing the cooling water into contact with the liquid cooling pipe 52 to cool the liquid (beer) 20. By varying the stirring speed, that is, the rotation speed of the stirring blade 582, cooling speed of the liquid 20 can be adjusted.

For example, by rotating the stirring blade 582 faster than usual, that is, faster than "non-controlled rotation speed" described below, it is possible to improve heat exchange efficiency and cool the liquid 20 more rapidly than usual. On the other hand, such high speed rotation consumes a larger amount of ice in the cooling water 55. Consuming the larger amount of ice means that the "consumed coolability" described in the first embodiment becomes larger.

Thus, it can be said that a control content regarding the stirring device in the second embodiment is a premise of the control content regarding the refrigeration machine 53 in the first embodiment. In other words, by controlling the rotation speed of the stirring blade 582, the liquid 20 is dispensed without unnecessarily increasing the rotation speed of the stirring blade 582. As a result, while consumption of the coolability in the dispensing device 50 is suppressed, it is possible to increase the amount of the liquid 20 dispensed at the target dispensing temperature (about 5° C.) for quality management of the liquid 20 (beer) to be provided.

Namely, also in the liquid quality management device 101-2 in the second embodiment, similarly to the liquid quality management device 101-1 described above, it is possible to increase an amount of dispensed liquid maintained in a predetermined dispensing temperature range compared to the conventional one. Therefore, in the second embodiment, by performing control to make the rotation speed of the stirring blade 582 variable depending on the temperature of the liquid 20 detected through the liquid temperature sensor 140, it is possible to increase the amount of beer dispensed at the target dispensing temperature, for example, about 5° C., for quality management of the beer (liquid 20) to be provided.

As shown in FIG. 3, the above mentioned liquid quality management device 101-2 includes the flow rate sensor 111 and the liquid temperature sensor 140, and the control device 130 is referred to as a control device 130-2 in the second embodiment. The liquid quality management device 101-2 can increase the amount of liquid dispensed in the predetermined dispensing temperature range compared to the conventional one by controlling operation of the stirring device 58 from the starting time of dispensing the liquid 20 from the dispensing device 50. The control device 130-2 also includes a rotation speed acquisition unit 133, a liquid temperature information storage unit 135, and a liquid temperature information update unit 137.

The rotation speed acquisition unit 133 obtains a stirring rotation speed in the stirring device 58 according to the liquid temperature detected through the liquid temperature sensor 140, and an already-obtained relationship between the stirring rotation speed in the stirring device 58 and the coolability. Then, the control device 130-2 rotates the stirring blade 582 of the stirring device 58 according to the obtained stirring rotation speed, that is, at the obtained stirring rotation speed.

Here, the above-mentioned "already obtained relationship between the stirring rotation speed and the coolability" means that there is a mutual relationship between the stirring rotation speed and a cooling degree of the liquid 20 as described above and the mutual relationship has been obtained in advance through applicant's experiments, etc.

The liquid temperature information storage unit 135 stores the temperature of the liquid 20 detected through the liquid temperature sensor 140. Here, the temperature of the liquid 20 is the temperature of the liquid 20 at the "immediately preceding time" as described above. Therefore, the liquid temperature information storage unit 135 stores the temperature of the liquid 20 at the immediately preceding time sent through the liquid temperature sensor 140 as liquid temperature information.

The liquid temperature information update unit 137 updates the liquid temperature information stored in the liquid temperature information storage unit 135. In other words, as described above, since the liquid temperature is detected for each dispensing operation of the liquid 20, assuming that this time is n-th time, liquid temperature detected through the liquid temperature sensor 140 in liquid dispensing operation of previous time corresponding to (n-1)th time may differ from liquid temperature detected in liquid dispensing operation of this time n-th. In this way, when the liquid temperature differs between the previous time and this time, the liquid temperature information update unit 137 updates liquid temperature information of previous time stored in the liquid temperature information storage unit 135 to liquid temperature information of this time.

Here, similarly to the control device 130-1, the control device 130-2 is actually realized by using a computer, and is composed of software corresponding to operations and functions in the rotation speed acquisition unit 133, the liquid temperature information storage unit 135, and the liquid temperature information update unit 137 and hardware for executing these.

Operation of the liquid quality management device 101-2 according to the second embodiment having the configuration mentioned above will be described below, particularly focusing on operation of the control device 130-2.

As explained above, the stirring blade 582 of the stirring device 58 is basically continuously driven without stopping. The rotation speed of the stirring blade 582 in an idling state where the rotation speed is not controlled by the control device 130-2 is referred to as "non controlled rotation speed". Here, the non-controlled rotation speed is basically not zero, but is a concept including zero, that is, a stopped state. Further, the non-controlled rotation speed may be read as the number of non-controlled rotations per unit time.

The operation of the control device 130-2 will be described with reference to FIG. 5.

In a state where the liquid 20 is not dispensed, the stirring blade 582 of the stirring device 58 provided in the dispensing device (beer dispenser) 50 rotates at the above non-controlled rotation speed, as shown in step S10.

In step S11, the control device 130-2 confirms whether or not the liquid (beer) 20 is dispensed due to detection through the dispensing sensor, which is the flow rate sensor 111 in the present embodiment. Note that as described in the first embodiment, the liquid temperature sensor 140 or the like can be used instead of the flow rate sensor 111.

When it is determined that the dispensing operation is performed (for convenience of explanation, this dispensing operation is called as dispensing operation of "this time"), in step S12, based on the liquid temperature information currently stored in the liquid temperature information storage unit 135, that is, the liquid temperature information obtained from the liquid temperature sensor 140 in the dispensing operation of "previous time", that, is, ""this time" minus one time" described above, the rotation speed acquisition unit 133 seeks or obtains the rotation speed of the stirring blade 582 according to the above "already-obtained relationship between the stirring rotation speed and the coolability". Then, the control device 130-2 changes the rotation speed of the stirring blade 582 in the stirring device 58 from the non-controlled rotation speed to the sought rotation speed of the rotation speed acquisition unit 133, and causes the stirring blade 582 to rotate. Note that a method of seeking the rotation speed is not limited to the explanation described above.

In the next step S13, the rotation speed acquisition unit 133 determines whether or not the liquid temperature information obtained from the liquid temperature sensor 140 through the dispensing operation of this time and the liquid temperature information of the previous time stored in the liquid temperature information storage unit 135 are different.

If they are different, in the next step S14, the rotation speed of the stirring blade 582 corresponding to the liquid temperature information of this time is sought. Then, the control device 130-2 rotates the stirring blade 582 with the obtained rotation speed. Note that since the difference in the liquid temperature information between the previous time and this time includes rise and fall in temperature, the rotation speed of the stirring blade 582 also increases and decreases correspondingly.

In the next step S15, the control device 130-2 determines whether or not the dispensing operation of this time has ended through the detection of the flow rate sensor 111. If the operation continues, the process returns to step S13, and if the operation has ended, the process proceeds to the next step S16.

Due to the liquid temperature information of this time is different from the liquid temperature information of the previous time (step S13), in step S16, the liquid temperature information update unit 137 in the control device 130-2 updates the liquid temperature information of the previous time stored in the liquid temperature information storage unit 135 to the liquid temperature information of this time. Further, the control device 130-2 returns the rotation speed of the stirring blade 582 to the non-controlled rotation speed.

As described above, also in the liquid quality management device 1012 according to the second embodiment, similarly to the liquid quality management device 101-1 according to the first embodiment, the control device 130-2 starts the operation control of the stirring device 58 from the starting time of dispensing of the liquid 20 (steps S11 and S12). Compared to the conventional control in which the operation of the refrigeration machine is started from the time when the frozen state in the cooling water 55 changes, it is possible to increase the amount of beer dispensed at the target dispensing temperature, for example, about 5° C., for quality management of the beer (liquid 20) to be provided. In other words, it is possible to provide the liquid (beer) 20 with more stable quality than the conventional case.

It is also possible to adopt a configuration in which the second embodiment described above and the first embodiment described above are combined.

As described above, the rotation speed of the stirring blade 582 and an amount of consumption of ice in the cooling water 55, that is, the "consumed coolability" described in the first embodiment are related to each other. Therefore, by combining the second embodiment and the first embodiment, it is possible to increase the amount of the liquid 20 dispensed at the target dispensing temperature more than a case of the first embodiment or the second embodiment alone. Therefore, the liquid (beer) 20 can be provided with further stable quality in the combined configuration.

Further, in each of the above-described embodiments, "electrically connected" means a concept that includes not only wired connection but also wireless connection.

Although the present, invention has been fully described in connection with preferred embodiments thereof with reference to the accompanying drawings, various changes and modifications will be apparent to those skilled in the art. It is to be understood that such changes and modifications are intended to be included therein without departing from the scope of the invention as set forth in the appended claims.

In addition, all the disclosure contents of description, drawings, claims, and abstract in Japanese Patent Application No. 2018-056631 filed on Mar. 23, 2018, are hereby incorporated into the present description by reference.

INDUSTRIAL APPLICABILITY

The present invention is applicable to a liquid quality management device and method that can be added to a liquid supply system.

DESCRIPTION OF REFERENCE SYMBOLS

10 STORAGE CONTAINER
30 SUPPLY PIPE
40 DRINKING CONTAINER
50 DISPENSING DEVICE
51 COOLING TANK
52 LIQUID COOLING PIPE
53 REFRIGERATION MACHINE
54 LIQUID DISPENSING OUTLET
55 COOLING WATER
57 REFRIGERANT PIPE
58 STIRRING DEVICE
70 LIQUID SUPPLY SYSTEM
101, 101-1, 101-2 LIQUID QUALITY MANAGEMENT DEVICE
111 FLOW RATE SENSOR
130, 130-1, 130 2 CONTROL DEVICE
140 LIQUID TEMPERATURE SENSOR
160 RECEIVING UNIT

The invention claimed is:

1. A liquid quality management device capable of being added to a liquid supply system, the liquid supply system supplying a liquid within a storage container to a dispensing device through a supply pipe with the liquid pressurized in order to cool the liquid with a cooling device in the dispensing device, and dispensing the cooled liquid to a drinking container from the dispensing device, the cooling device including a cooling tank containing cooling water, a liquid cooling pipe immersed in the cooling water and through which the liquid flows inside, a refrigerant pipe immersed in the cooling water and through which a refrigerant flows inside, a refrigeration machine circulating the refrigerant and freezing a part of the cooling water, and a stirring device stirring the cooling water, the liquid quality management device comprising:

a dispensing sensor configured to detect dispensing of the liquid into the drinking container;

a control device electrically connected to the dispensing sensor and configured to control operation of at least one of the refrigeration machine and the stirring device from a starting time of dispensing of the liquid; and a liquid temperature sensor disposed between the storage container and an inlet of the liquid cooling pipe and configured to detect a temperature of the liquid flowing out from the storage container, wherein the control device further includes a rotation speed acquisition unit configured to obtain a stirring rotation speed in the stirring device from the temperature of the liquid detected through the liquid temperature sensor and an already-obtained relationship between the stirring rotation speed in the stirring device and a coolability, and the control device is configured to operate the stirring device according to the obtained stirring rotation speed from the starting time of dispensing.

2. The liquid quality management device according to claim 1, further comprising a liquid temperature sensor disposed between the storage container and an inlet of the liquid cooling pipe, and configured to detect a temperature of the liquid flowing out from the storage container, wherein the dispensing sensor is a flow rate sensor configured to detect an amount of liquid dispensed into the drinking container, and the control device includes a consumed coolability acquisition unit configured to obtain a coolability consumed by the cooling water from the temperature of the liquid and the amount of dispensed liquid, and an operation time acquisition unit configured to obtain an operation time of the refrigeration machine from the obtained consumed coolability and a known coolability of the refrigeration machine, and the control device is configured to operate the refrigeration machine for the operation time from the starting time of dispensing.

3. The liquid quality management device according to claim 1, wherein the control device further includes a time management unit configured to manage time information, and in addition to the operation control from the starting time of dispensing, the control device is configured to control operation of the refrigeration machine such that the cooling water has a maximum coolability at a set time.

4. The liquid quality management device according to claim 3, further comprising a receiving unit electrically connected to the control device and configured to receive information via a communication line, wherein the control device is configured to determine the set time based on the received information to control the operation of the refrigeration machine.

5. A liquid quality management method executed by using a liquid quality management device, the liquid quality management device capable of being added to a liquid supply system, the liquid supply system supplying a liquid within a storage container to a dispensing device through a supply pipe with the liquid pressurized in order to cool the liquid with a cooling device in the dispensing device, and dispensing the cooled liquid to a drinking container from the dispensing device, the liquid quality management device including a dispensing sensor configured to detect dispensing of the liquid into the drinking container, the liquid quality management method, comprising controlling operation of at least one of a refrigeration machine provided in the cooling device and a stirring device from a starting time of dispensing of the liquid into the drinking container detected through the dispensing sensor, wherein the cooling device includes a cooling tank containing cooling water and a liquid cooling pipe immersed in the cooling water and through which the liquid flows inside, and the liquid quality management device further includes a liquid temperature sensor disposed between the storage container and the liquid cooling pipe and configured to detect a temperature of the liquid flowing out from the storage container, the liquid quality management method, further comprising obtaining a stirring rotation speed in the stirring device from the temperature of the liquid detected through the liquid temperature sensor and an already-obtained relationship between the stirring rotation speed in the stirring device and a coolability, and operating the stirring device according to the obtained stirring rotation speed from the starting time of dispensing the liquid detected through the dispensing sensor.

6. The liquid quality management method according to claim 5, wherein the cooling device includes a cooling tank containing cooling water and a liquid cooling pipe immersed in the cooling water and through which the liquid flows inside, the dispensing sensor is a flow rate sensor configured to detect an amount of liquid dispensed into the drinking container, and the liquid quality management device further includes a liquid temperature sensor disposed between the storage container and an inlet of the liquid cooling pipe and configured to detect a temperature of the liquid flowing out from the storage container, the liquid quality management method, further comprising:

obtaining a coolability consumed by the cooling water from the temperature of the liquid and the amount of dispensed liquid; and obtaining an operation time of the refrigeration machine from the obtained consumed coolability and a known coolability of the refrigeration machine, and operating the refrigeration machine for the operation time from the starting time of dispensing of the liquid.

* * * * *